US006126579A

United States Patent [19]

Lin

[11] Patent Number: 6,126,579

[45] Date of Patent: Oct. 3, 2000

[54] WEIGHT DEVICE OF AN EXERCISER

[76] Inventor: Chia Lu Lin, No. 1335-1, Sec. 1, Sung-Chu Road, Taichung, Taiwan

[21] Appl. No.: 09/245,071

[22] Filed: Feb. 5, 1999

[51] Int. Cl.[7] ..... A63B 21/06

[52] U.S. Cl. ..... 482/98; 482/99

[58] Field of Search ..... 482/94, 98–103

[56] References Cited

U.S. PATENT DOCUMENTS 3,840,227 10/1974 Chesemore ..... 482/102

4,614,338 9/1986 Castillo ..... 482/98

*Primary Examiner*—John Mulcahy

*Attorney, Agent, or Firm*—Rosenberg, Klein & Lee

[57] ABSTRACT

A weight device of an exerciser. The exerciser including two guide rods respectively passing through two through holes of an inclined rest board. Multiple weight blocks are placed on the rest board. A front side of the weight block is formed with two insertion slots. The guide rods are inserted into the insertion slots. The inclined rest board makes the weight of the weight blocks downward distributed. So, the weight blocks can be moved up and down without dropping out during operation. The weight blocks are only slightly guided by the guide rods so that it is unnecessary to accurately locate the weight blocks and this greatly reduces the manufacturing cost for the exerciser. Also, the weight blocks can be arbitrarily placed in or taken out and thus when assembling the exerciser, it is unnecessary to assemble the weight blocks with the exerciser at the same time. Therefore, it is easier to assemble the exerciser.

7 Claims, 7 Drawing Sheets

WEIGHT DEVICE OF AN EXERCISER

BACKGROUND OF THE INVENTION

The present invention relates to a weight device of an exerciser, in which the weight blocks can be arbitrarily placed in or taken out. In addition, during operation, the weight blocks can be moved up and down without dropping out.

FIGS. 6 and 7 show an existing exerciser including a weight device 8 capable of changing the training weight. Such weight device 8 has a base seat 81 on which two parallelly upward extending guide rods 82 are disposed. The guide rods 82 are passed through the guide holes 831 of multiple weight blocks 83. A middle portion of each weight block 83 is formed with a through hole 832 in which an adjustment rod 84 is passed. The adjustment rod 84 is formed with multiple locating holes 841 at equal intervals. The adjustment rod 84 is disposed on a middle portion of a guide board 85 positioned above the weight blocks 83. The guide rod 82 can be passed through the guide holes 831 only in an axial direction. In addition, the bottom of the guide rod 82 is tightly fixedly connected with the base seat 81. Therefore, in assembling, the weight blocks 83 must be placed in from upper end of the guide rod 82 to lower end thereof. Such procedure is quite troublesome.

In addition, the number of the weight blocks 83 is adjusted in such a manner that an insertion pin 86 is inserted into one of the locating holes 841 of the adjustment rod 84 to lift the weight blocks 83 with heavy weight. In the case of insufficient strength, the insertion pin 86 is often bent and damaged. Moreover, in order to entirely insert the adjustment rod 84 into the through holes 832 of all the weight blocks 83, the accuracy of alignment of the through holes 832 of the weight blocks 83 and the adjustment rod 84 must be increased. Also, the adjustment rod 84 is fixed on the guide board 85 so that it is important to have more accuracy between the guide board 85 and the guide rod 82 as well as the adjustment rod 84. This increases the manufacturing cost for the exerciser.

SUMMARY OF THE INVENTION

It is therefore a primary object of the present invention to provide a weight device of an exerciser. The inclined rest board makes the weight of the weight blocks downward distributed, whereby during operation, the weight blocks can be moved up and down without dropping out. In addition, the weight blocks are only slightly guided by the guide rods so that the requirement of accuracy is reduced and the manufacturing cost is lowered.

It is a further object of the present invention to provide the above weight device in which the weight blocks can be arbitrarily placed in or taken out and thus when assembling the exerciser, it is unnecessary to assemble the weight blocks with the exerciser at the same time. Therefore, it is easier to assemble the exerciser.

According to the above objects, the weight device of the present invention is installed on an exerciser having multiple force application sections. Abottom of the exerciser is fixedly disposed with two upward extending guide rods parallel to each other. The guide rods respectively pass through two through holes of a rest board. A top face of the rest board is a slope board downward inclined from one side to the other side. An upward extending pull cord is disposed at a middle section of the rest board and conducted to the respective force application sections. Multiple weight blocksare placed on the rest board. Each weight block is a polygonal block.

A front side of the weight block is formed with two insertion slots passing through a top face and a bottom face of the weight block and extending to a middle portion of the weight block. The guide rods are inserted into the insertion slots. A slit is formed on the weight block between the insertion slots for the pull cord to pass therethrough.

The present invention can be best understood through the following description and accompanying drawings, wherein:

DETAILED DESCRIPTION OF THE PREFERRED EMBODIMENT

Figure 1:
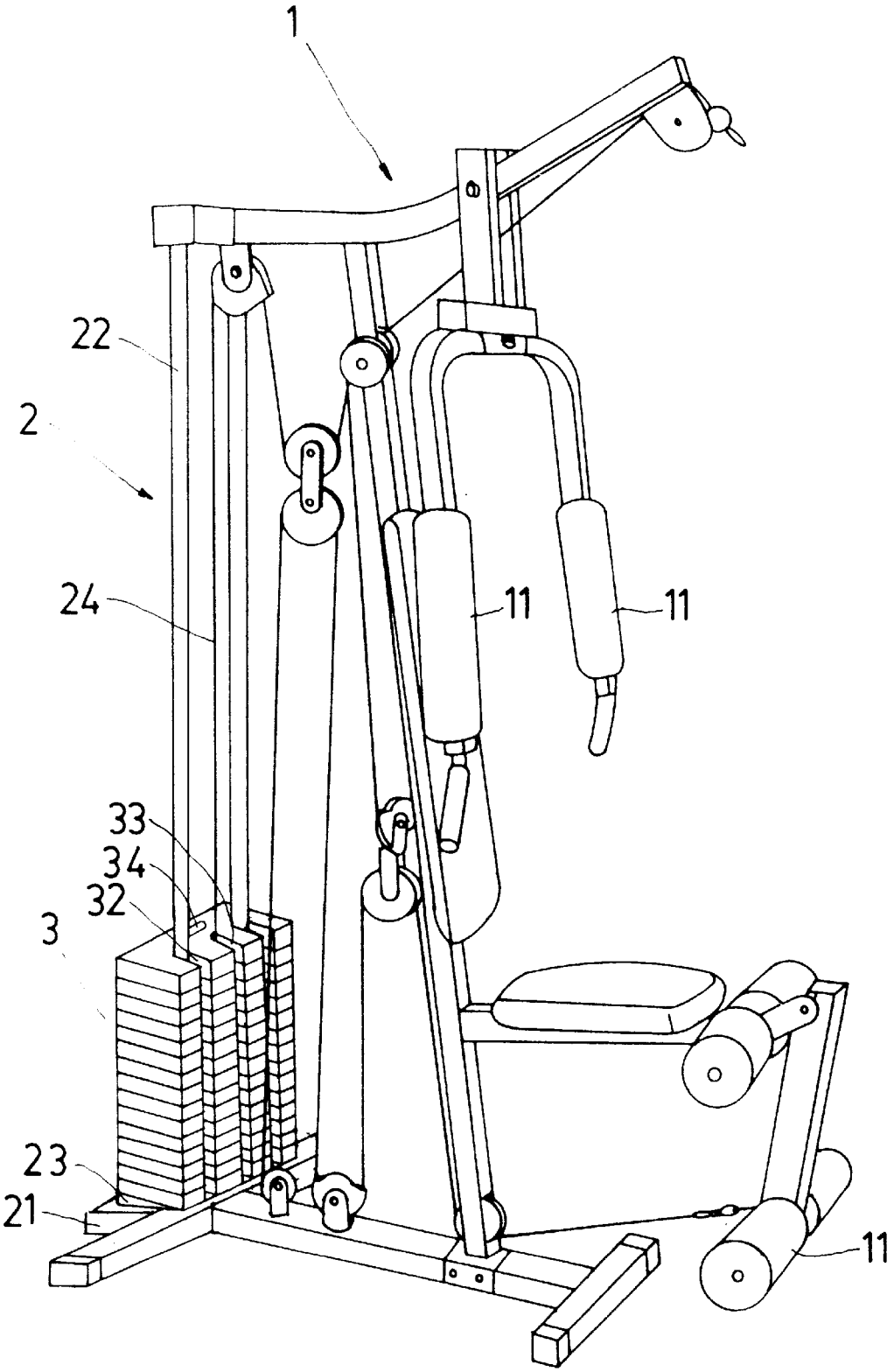
FIG. 1 is a perspective view of the present invention, showing that the weight device is assembled with an exerciser.
Figure 2:
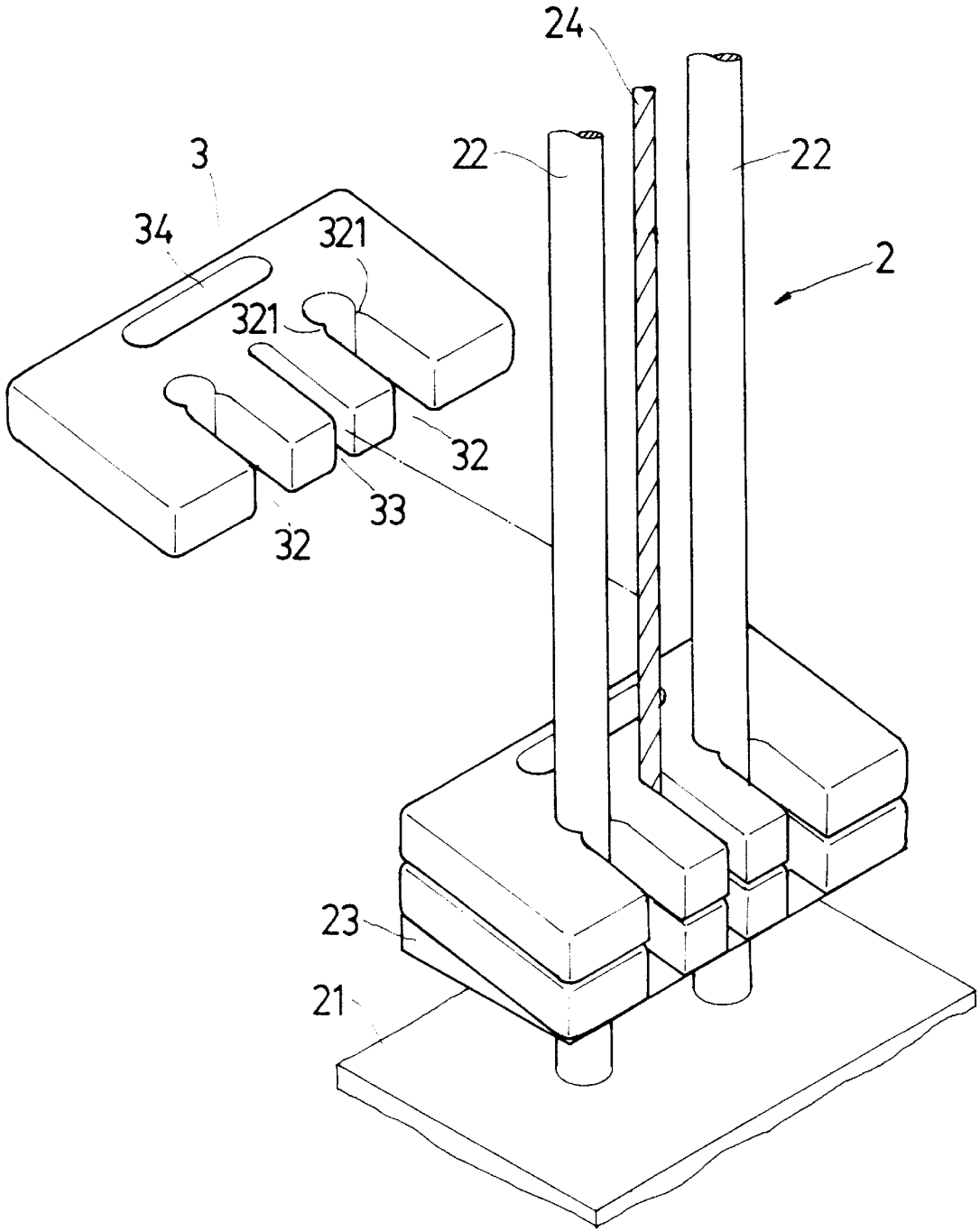
FIG. 2 is a perspective view of the weight block of the present invention.
Figure 3:
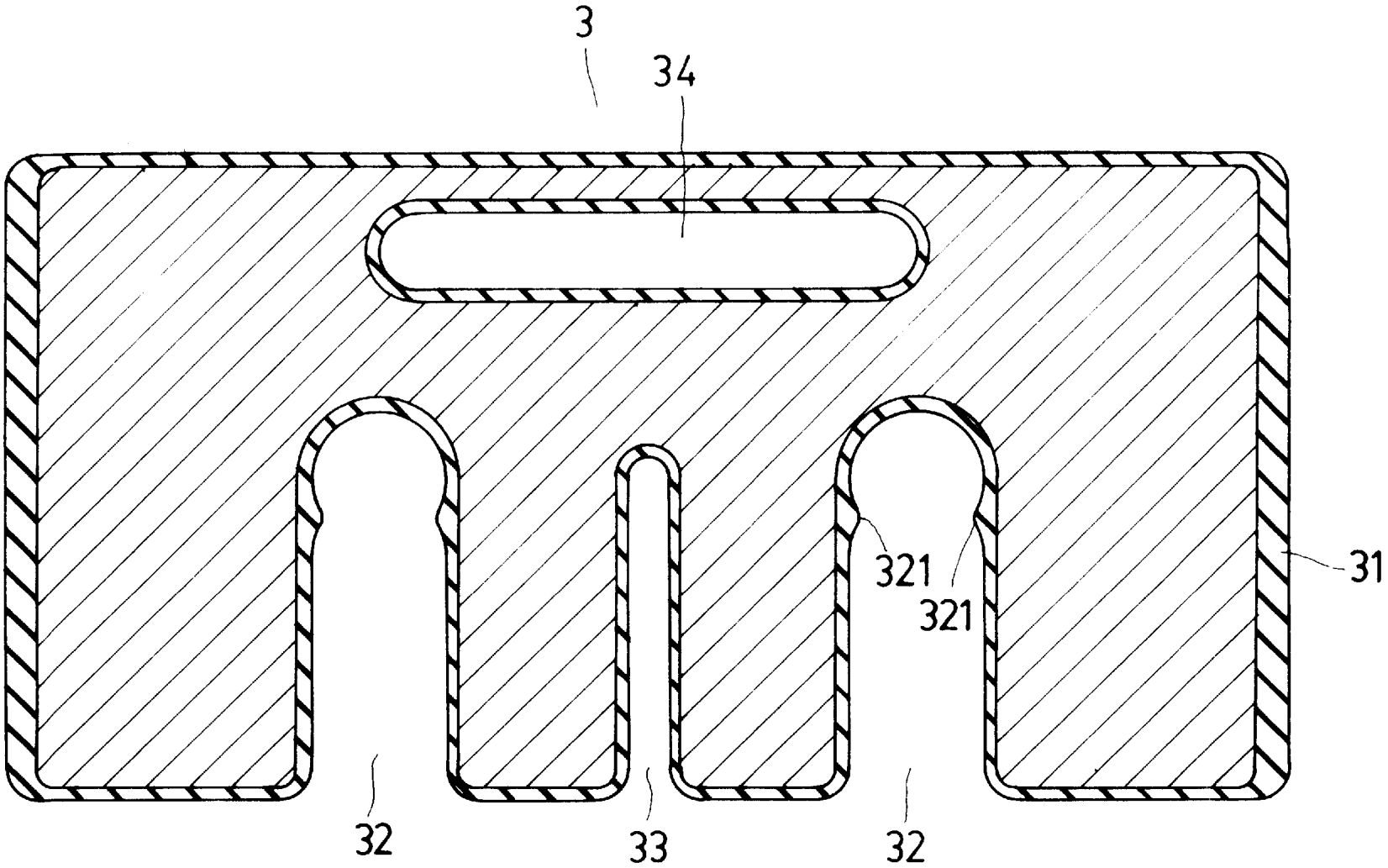
FIG. 3 is a sectional view of the weight block of the present invention.

Please refer to FIGS. 1 to 5. According to a preferred embodiment of the present invention, the weight device 2 is mounted on an exerciser 1 having multiple force application sections 11 for a user to exercise. The weight device 2 includes a buffering block 21 disposed on the bottom of the exerciser 1. The buffering block 21 is fixedly disposed with two upward extending guide rods 22 parallel to each other. The guide rods 22 respectively pass through two through holes 231 of a rest board 23. The rest board 23 is downward inclined from rear side to front side. A middle section of the rest board 23 is disposed with an upward extending pull cord 24 conducted to the respective force application sections 11 of the exerciser 1. Multiple weight blocks 3 are placed on the rest board 23. The weight block 3 is made of metal material and covered with a plastic layer 31. The weight block 3 is a rectangular block which is downward inclined from rear side to front side. A front side of the weight block 3 is formed with two insertion slots 32 passing through the top and bottom face of the weight block 3 and rearward extending to a middle portion of the weight block 3. The guide rods 22 are inserted into the insertion slots 32. A bottom of the insertion slot 32 is arched. The inner wall of the bottom of the insertion slot 32 and the bottom face of the weight block 3 contain an angle less than 90 degrees. Two sides of the insertion slot 32 near the bottom are respectively disposed with two projections 321 formed by plastic layer 31 for stopping the guide rod 22 from slipping out. A slit 33 is formed on the weight block 3 between the insertion slots 32. The slit 33 rearward extends from the front side to the middle portion of the weight block 3, having a width less than that of the insertion slot 32. A pull slot 34 is formed at rear end of the weight block 3 for a user to pull out the weight block 3.

Please refer to FIGS. 2 to 5. In use of the present invention, a user operating the exerciser 1 must decide a weight suitable for the part of the body to be trained. The weight can be obtained by adding or subtracting the number of the weight blocks 3. The weight blocks 3 can be one by one placed from rear side of the exerciser 1 onto the rest board 23. The two insertion slots 32 of the weight block 3 are aligned with the guide rods 22 and pushed inward with the guide rods 22 respectively fitted into the insertion slots 32. Also, the pull cord 24 is passed into the slit 33. At this time, the user can apply a force onto the force application section 11 to pull the pull cord 24. The pull cord 24 in turn pulls up the rest board 23 with the weight blocks 3 so as to achieve an exercising effect.

Figure 4:
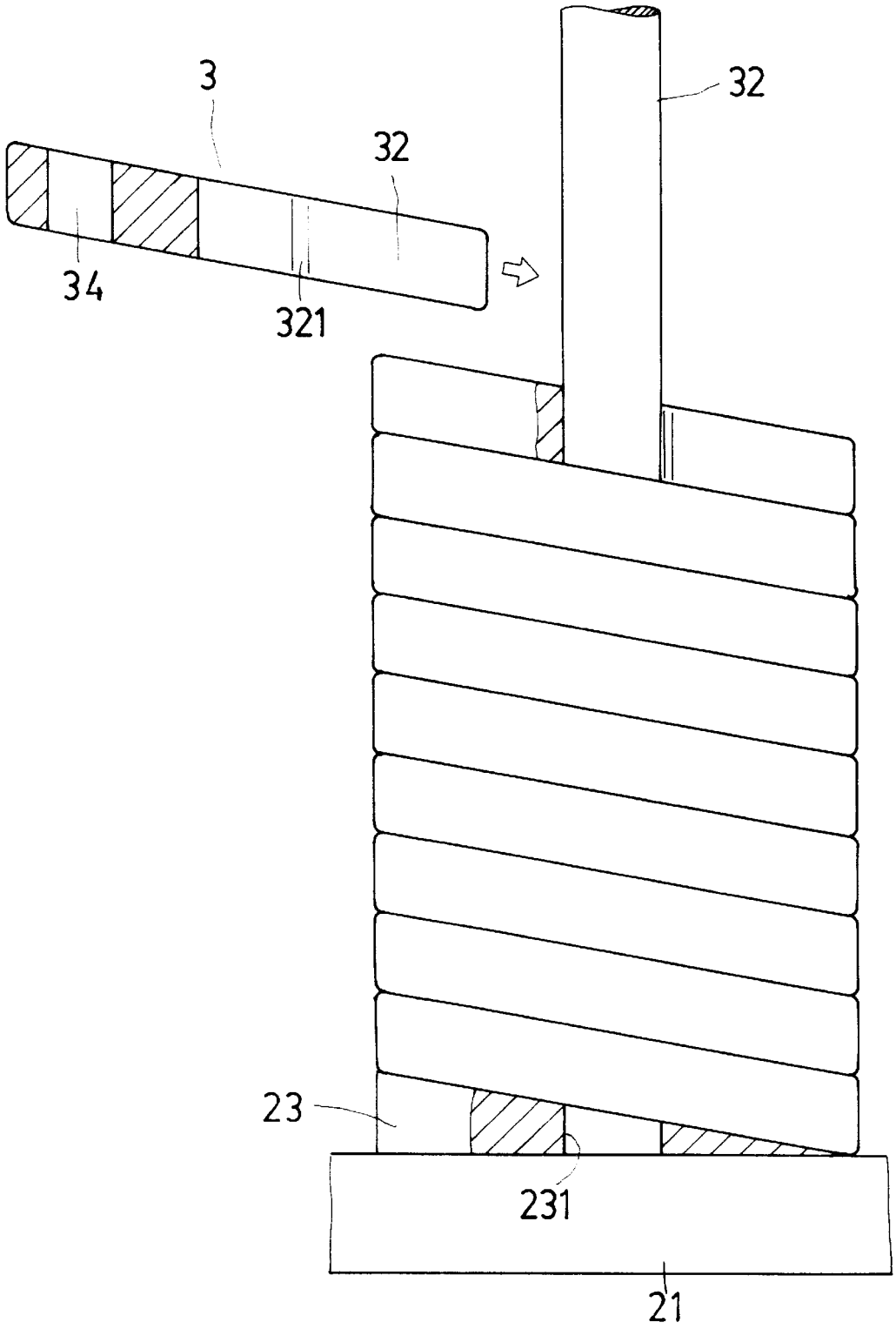
FIG. 4 shows the use of the present invention in one state.
Figure 5:
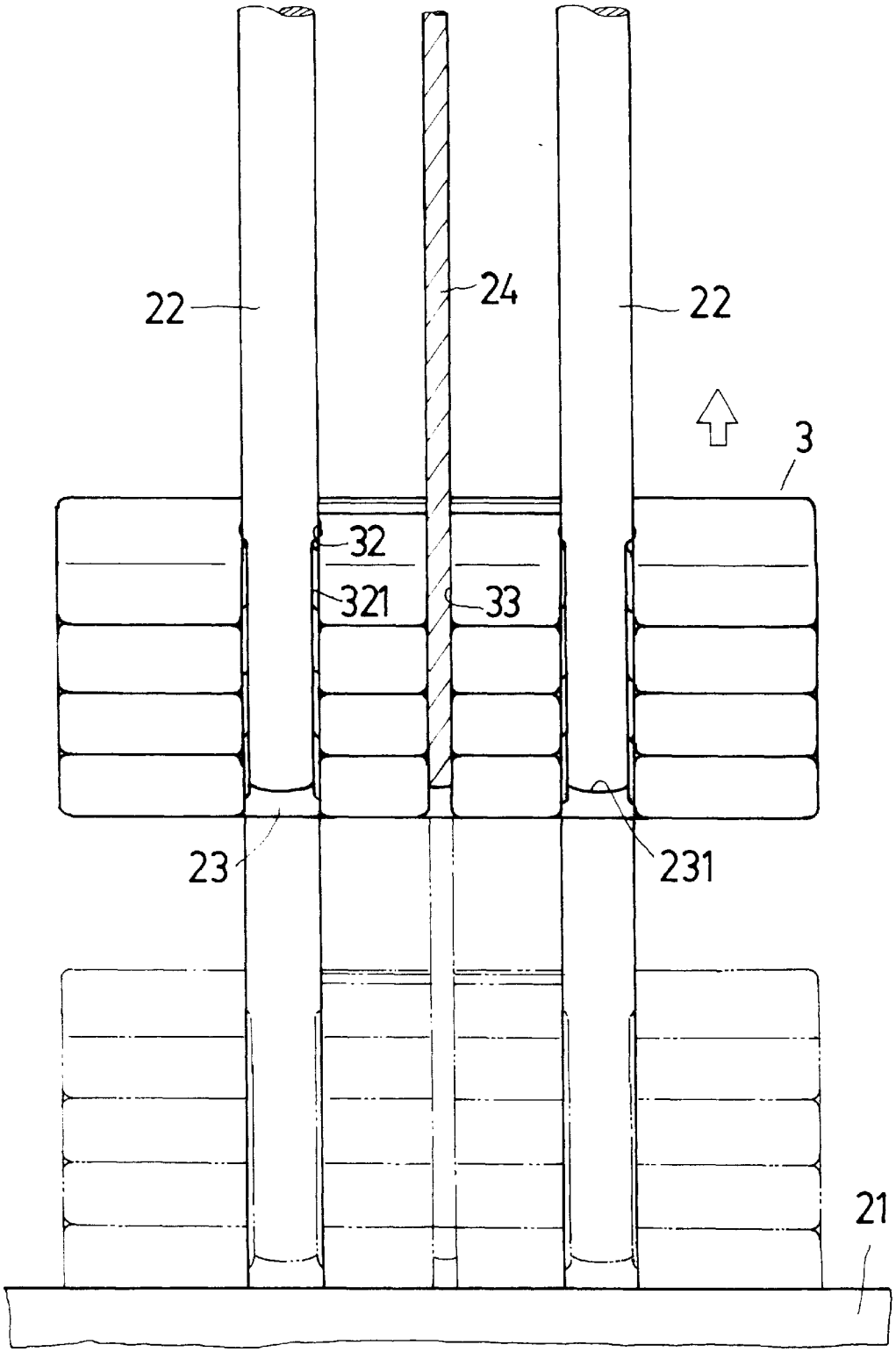
FIG. 5 shows the use of the present invention in another state.
Figure 6:
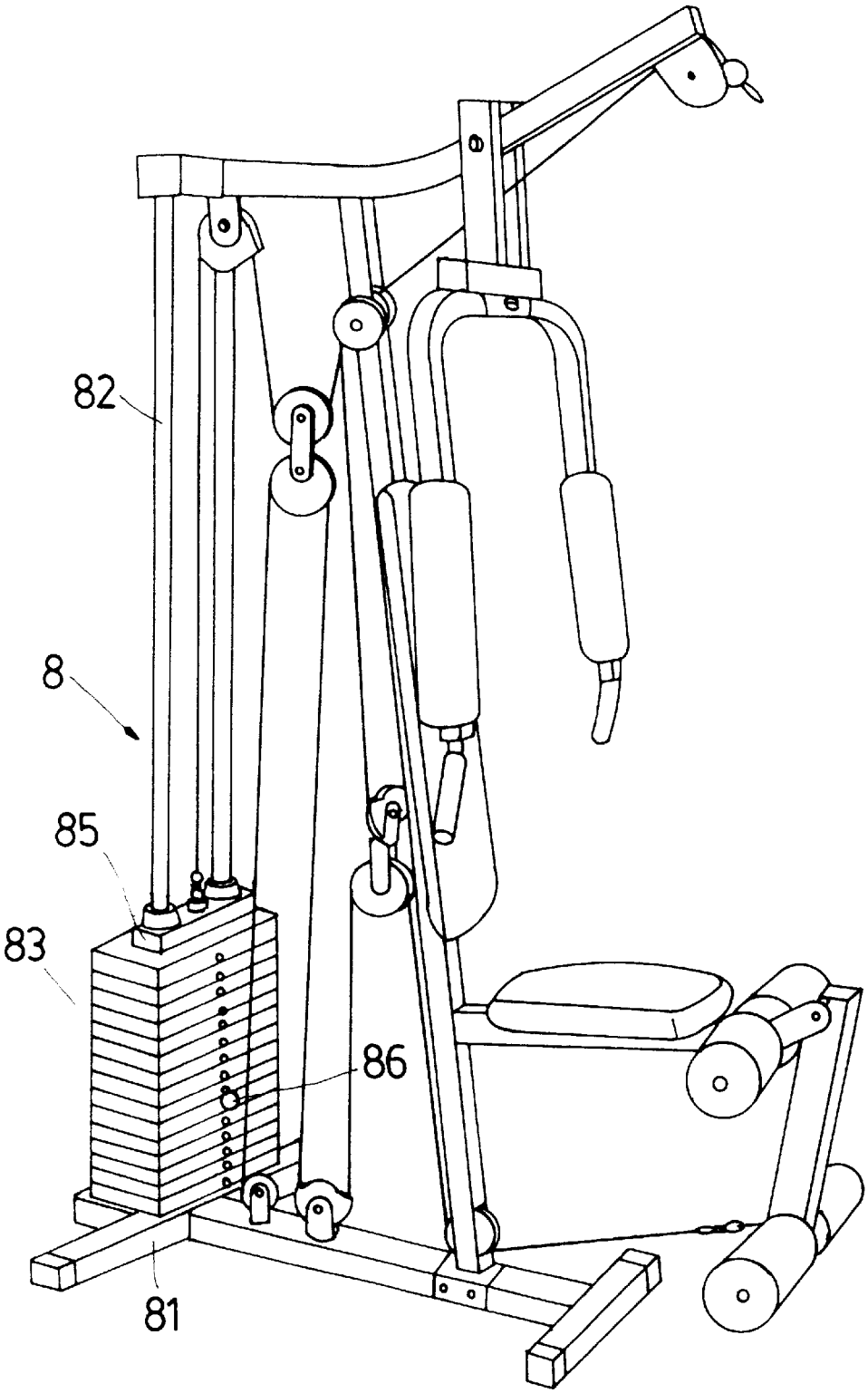
PRIOR ART FIG. 6
FIG. 6 is a perspective view of a conventional exerciser.
Figure 7:
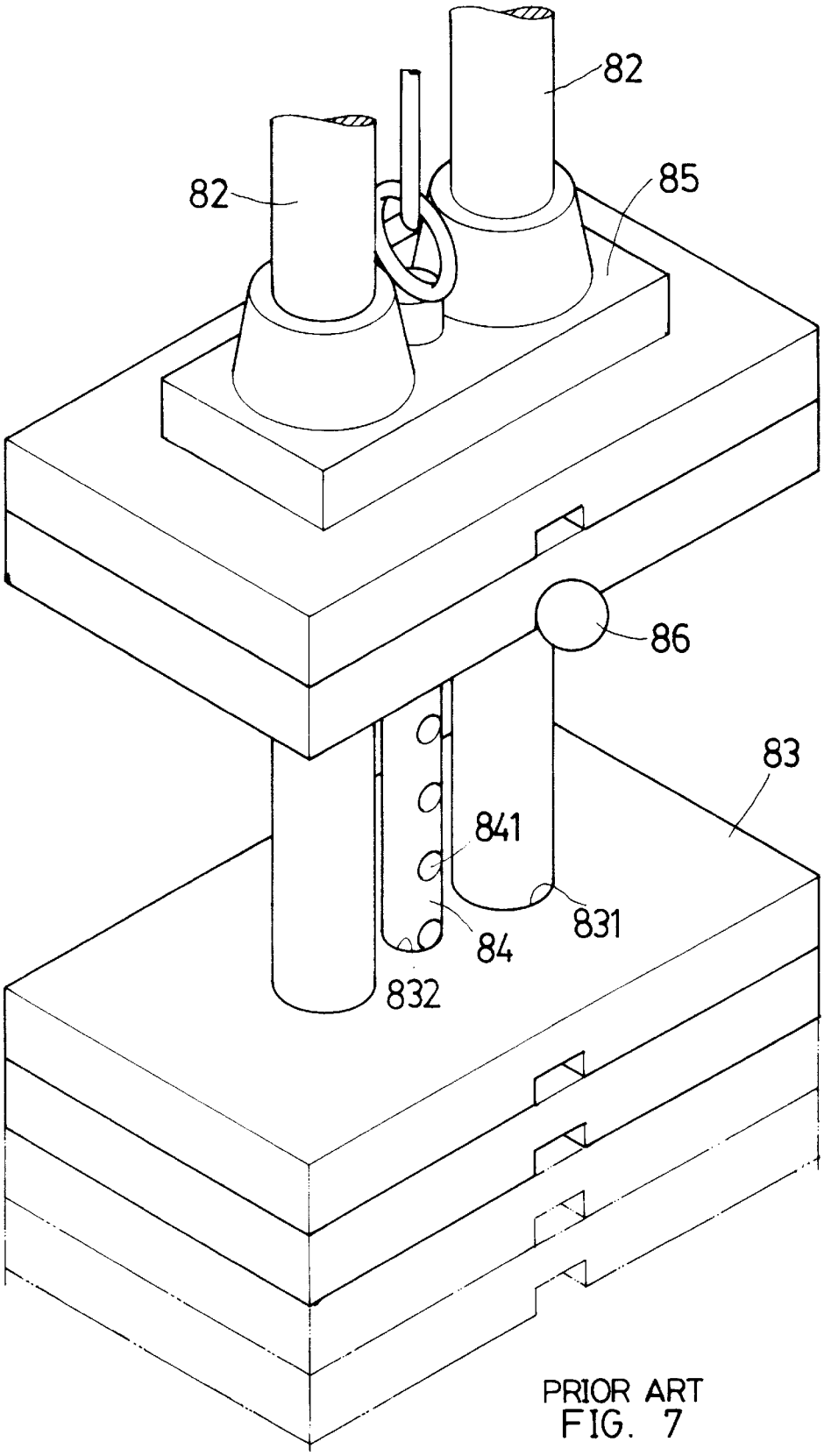
PRIOR ART FIG. 7
FIG. 7 is an enlarged perspective view of the weight device of the conventional exerciser.

According to the above arrangement, a certain number of weight blocks 3 can be placed onto the rest board in accordance with the necessary weight for training the user. In assembling of the exerciser 1, it is unnecessary to mount the weight blocks 3 thereon so that it is easier to assemble the exerciser 1. Especially, the weight blocks 3 are placed on the inclined rest board 23, whereby the slope face of the rest board 23 makes the weight of the weight blocks 3 distributed forward and downward (as shown in FIG. 4). Therefore, the weight blocks 3 are uneasy to drop out from the rear side. Accordingly, even when the weight blocks 3 drop quickly during operation, the weight thereof will be only distributed more forward and thus the weight blocks 3 are prevented from dropping out. Also, the projections 321 in the insertion slots 32 serve to restrict the moving of the weight blocks 3 so as to avoid over-swinging of the weight blocks 3. Moreover, the weight blocks 3 are only slightly guided by the guide rods 22 so that it is unnecessary to accurately locate the weight blocks 3. This greatly reduces the manufacturing cost for the exerciser.

It is to be understood that the above description and drawings are only used for illustrating one embodiment of the present invention, not intended to limit the scope thereof. Any variation and derivation from the above description and drawings should be included in the scope of the present invention.

What is claimed is:

1. A weight device of an exerciser, which is mounted on the exerciser having multiple force application sections, a bottom of the exerciser being fixedly disposed with two upward extending guide rods parallel to each other, the guide rods respectively passing through two through holes of a rest board, a top face of the rest board being a slope board downward inclined from one side to the other side, an upward extending pull cord being disposed at a middle section of the rest board, the pull cord being conducted to the respective force application sections, multiple weight blocks being placed on the rest board, each weight block being a polygonal block, a front side of the weight block being formed with two insertion slots passing through a top face and a bottom face of the weight block and extending to a middle portion of the weight block, the guide rods being inserted into the insertion slots, a slit being formed on the weight block between the insertion slots for the pull cord to pass therethrough.

2. A weight device as claimed in claim 1, wherein the weight device includes a buffering block disposed on the bottom of the exerciser, the buffering block being fixedly connected with the guide rods.

3. A weight device as claimed in claim 1, wherein the weight block is made of metal material and covered by a plastic layer.

4. A weight device as claimed in claim 1, wherein the bottom of the insertion slot is arched and two sides of the insertion slot near the bottom thereof are respectively disposed with two projections for stopping the guide rod from slipping out.

5. A weight device as claimed in claim 1, wherein the width of the slit is less than the width of the insertion slot.

6. A weight device as claimed in claim 1, wherein a rear end of the weight block is formed with a pull slot for a user to pull out the weight block.

7. A weight device as claimed in claim 1, wherein an inner wall of the bottom of the insertion slot and a bottom face of the weight block contain an angle less than 90 degrees.

* * * * *